US005889540A

United States Patent [19]

Leonard et al.

[11] Patent Number: 5,889,540

[45] Date of Patent: Mar. 30, 1999

[54] DIRECT ELECTROSTATIC PRINTING DEVICE (DEP) AND PRINTHEAD STRUCTURE WITH LOW CURRENT FLOW BETWEEN SHIELD AND CONTROL ELECTRODES

[75] Inventors: Jacques Leonard, Antwerpen; Guido Desie, Herent, both of Belgium

[73] Assignee: Agfa-Gevaert, Mortsel, Belgium

[21] Appl. No.: 574,775

[22] Filed: Dec. 19, 1995

[30] Foreign Application Priority Data

Dec. 27, 1994 [EP] European Pat. Off. ..... 94203764
Jan. 16, 1995 [EP] European Pat. Off. ..... 95200095

[51] Int. Cl.[6] ..... B41J 2/06; B41J 2/415; B41J 2/39; B41J 2/395

[52] U.S. Cl. ..... 347/55; 347/141

[58] Field of Search ..... 347/111, 120, 347/123, 141, 159, 161, 163, 128, 55, 127; 216/17

[56] References Cited

U.S. PATENT DOCUMENTS 5,095,322 3/1992 Fletcher ..... 347/55
5,138,348 8/1992 Hosaka et al. ..... 347/128
5,256,246 10/1993 Kitamura ..... 216/17
5,278,588 1/1994 Kubelik ..... 347/127
5,327,169 7/1994 Thompson ..... 347/55
5,441,593 8/1995 Baughman et al. ..... 347/65

FOREIGN PATENT DOCUMENTS 60-135266 7/1985 Japan .

*Primary Examiner*—Benjamin R. Fuller
*Assistant Examiner*—Raquel Yvette Gordon
*Attorney, Agent, or Firm*—Baker & Botts, L.L.P.

[57] ABSTRACT

An apparatus for direct electrostatic printing includes a back electrode and a printhead structure having a plastic insulating layer and printing apertures arranged therein. Individual control electrodes are combined with the printing apertures on a first side of the insulating layer, and a shield electrode is combined with the printing apertures on a second side of the insulating layer. A toner delivery apparatus is also included for delivering a cloud of dry toner particles in the vicinity of the printing apertures. The printing apertures are constructed and arranged such that, when applying a potential difference of 200V between the shield electrode and each individual control electrode, a current of no more that 50 $\mu$A flows from each individual control electrode to the corresponding shield electrode through the corresponding printing aperture. Methods for forming the printing apertures in such a printhead are also disclosed.

19 Claims, 1 Drawing Sheet

DIRECT ELECTROSTATIC PRINTING DEVICE (DEP) AND PRINTHEAD STRUCTURE WITH LOW CURRENT FLOW BETWEEN SHIELD AND CONTROL ELECTRODES

FIELD OF THE INVENTION

This invention relates to an apparatus used in the process of electrostatic printing and more particularly in Direct Electrostatic Printing (DEP). In DEP, electrostatic printing is performed directly from a toner delivery means on a receiving member substrate by means of an electronically addressable printhead structure.

BACKGROUND OF THE INVENTION

In DEP (Direct Electrostatic Printing) the toner or developing material is deposited directly in an imagewise way on a receiving substrate, the latter not bearing any imagewise latent electrostatic image. The substrate can be an intermediate endless flexible belt (e.g. aluminium, polyimide etc.). In that case the imagewise deposited toner must be transferred onto another final substrate. Preferentially the toner is deposited directly on the final receiving substrate, thus offering a possibility to create directly the image on the final receiving substrate, e.g. plain paper, transparency, etc. This deposition step is followed by a final fusing step.

This makes the method different from classical electrography, in which a latent electrostatic image on a charge retentive surface is developed by a suitable material to make the latent image visible. Further on, either the powder image is fused directly to said charge retentive surface, which then results in a direct electrographic print, or the powder image is subsequently transferred to the final substrate and then fused to that medium. The latter process results in an indirect electrographic print. The final substrate may be a transparent medium, opaque polymeric film, paper, etc.

DEP is also markedly different from electrophotography in which an additional step and additional member is introduced to create the latent electrostatic image. More specifically, a photoconductor is used and a charging/exposure cycle is necessary.

A DEP device is disclosed in e.g. U.S. Pat. No. 3,689,935. This document discloses an electrostatic line printer having a multi-layered particle modulator or printhead structure comprising:

- a layer of insulating material, called insulation layer;
- a shield electrode consisting of a continuous layer of conductive material on one side of the insulation layer;
- a plurality of control electrodes formed by a segmented layer of conductive material on the other side of the insulation layer; and
- at least one row of apertures.

Each control electrode is formed around one aperture and is insulated from each other control electrode.

Selected potentials are applied to each of the control electrodes while a fixed potential is applied to the shield electrode. An overall applied propulsion field between a toner delivery means and a receiving member support projects charged toner particles through a row of apertures of the printhead structure. The intensity of the particle stream is modulated according to the pattern of potentials applied to the control electrodes. The modulated stream of charged particles impinges upon a receiving member substrate, interposed in the modulated particle stream. The receiving member substrate is transported in a direction orthogonal to the printhead structure, to provide a line-by-line scan printing. The shield electrode may face the toner delivery means and the control electrode may face the receiving member substrate. A DC field is applied between the printhead structure and a single back electrode on the receiving member support. This propulsion field is responsible for the attraction of toner to the receiving member substrate that is placed between the printhead structure and the back electrode.

A DEP device is well suited to print half-tone images. The densities variations present in a half-tone image can be obtained by modulation of the voltage applied to the individual control electrodes. In most DEP systems large printing apertures are used for obtaining a high degree of density resolution (i.e. for producing an image comprising a high amount of differentiated density levels).

For text quality, however, a high spatial resolution is required. This means that small printing apertures must have to be made through said plastic material, said control electrodes and said shield electrode.

Providing printing apertures in a DEP printhead structure comprising two electrodes (control electrode and shield electrode) separated by an insulating plastic material, to yield a printhead capable of producing images with high resolution and also with uniform density pattern is not an obvious process.

All printing apertures in the printhead structure must have exactly the predetermined diameter, the electrodes must stay in place and have a well defined and constant shape, and the walls of the printing apertures through the insulating plastic must be smooth to avoid clogging of the printing apertures. After forming the printing apertures in the printhead structure, each aperture must be individually addressable such as to be able to yield any density between zero and maximum density. Moreover every printing aperture has to be addressable to the same extent in order to yield smooth density pattern.

There is still a need for a DEP system, using a printhead structure comprising two electrodes (control electrode and shield electrode) separated by an insulating plastic material and wherein printing apertures are present, wherein the printing apertures are not easily clogged by the toner particles and wherein each aperture is individually addressable in a reproducible way.

SUMMARY OF THE INVENTION

It is an object of the invention to provide an improved Direct Electrostatic Printing (DEP) device, printing high and low density levels with a high spatial resolution.

It is a further object of the invention to provide a DEP device combining high spatial resolution with good long term stability and reliability.

It is still a further object of the invention to provide a printhead structure for a DEP device, wherein said printhead structure comprises a control electrode and a shield electrode separated by an insulating (plastic) material and printing apertures made through both said electrodes and said insulating material wherein said printing apertures are not easily clogged by toner particles and are individually addressable in a stable an reproducible way.

It is another object of the invention to provide a method to make said printing apertures through both said electrodes and said insulating material.

Further objects and advantages of the invention will become clear from the description hereinafter.

The above objects are realized by providing a DEP device that comprises a back electrode (105), a printhead structure (106) comprising individual control electrodes (106*a*) in combination with printing apertures (107) and a shield electrode (106*b*), both electrodes separated by an insulating material and a toner delivery means (101) presenting a cloud (104) of dry toner particles in the vicinity of said printing apertures (107), characterised in that said apertures (107) are such that, when applying a potential difference of 200 V between said shield electrode and each individual control electrode, a current of at most 50 $\mu$A flows from said each individual control electrode to said shield electrode.

In a preferred embodiment said current between said each individual control electrode to said shield electrode is at most 10 $\mu$A, most preferably at most 3 $\mu$A.

In a further preferred embodiment said insulating material is at most 100 $\mu$m thick, more preferably at most 75 $\mu$m.

In a further preferred embodiment said insulating material is a plastic material, e.g. polyimide, polyester, polycarbonate, etc.

DETAILED DESCRIPTION OF THE INVENTION

Figure 1:
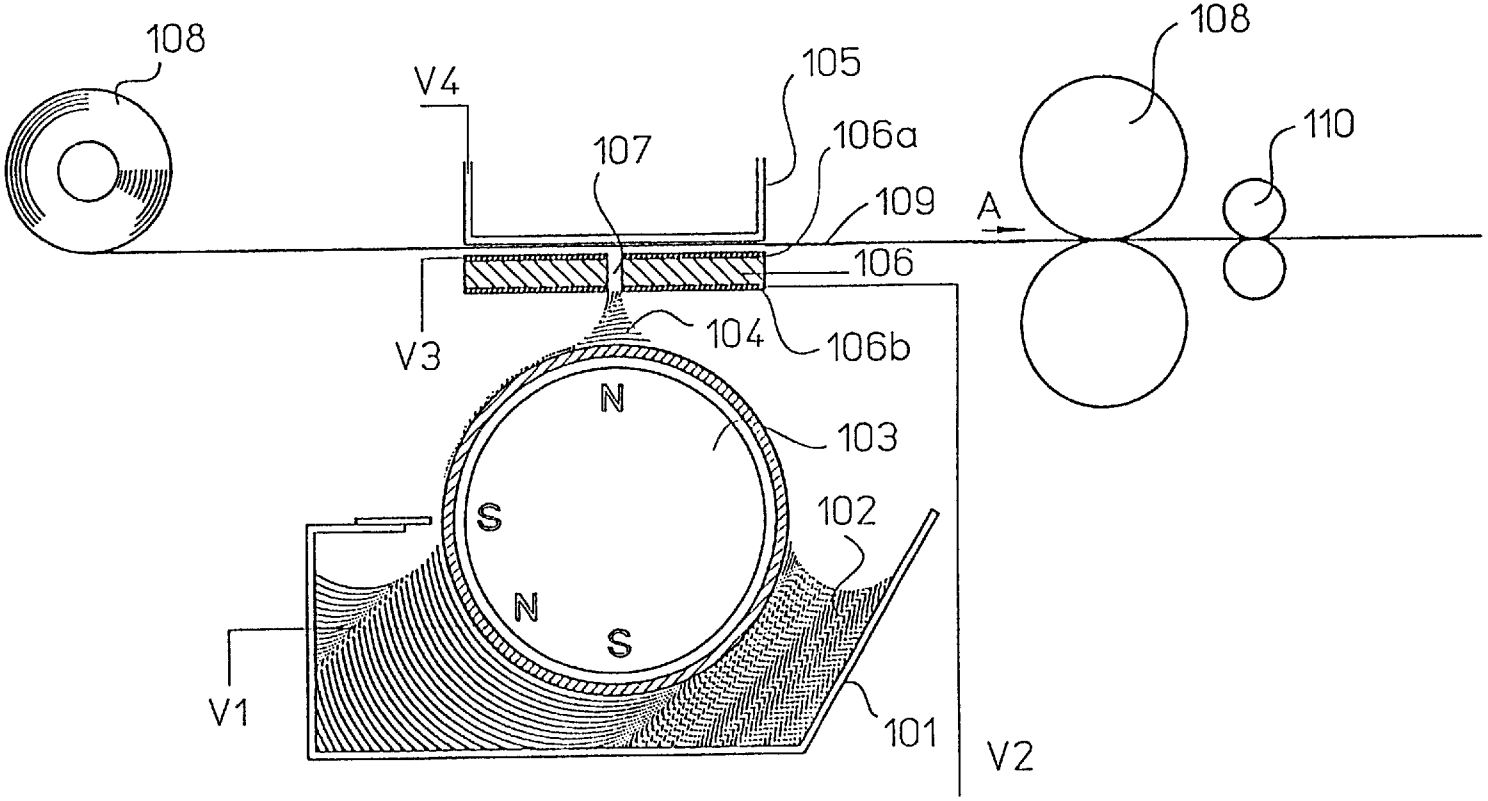
FIG. 1 is a schematic illustration of a possible embodiment of a DEP device according to the present invention.

In the literature many devices have been described that operate according to the principles of DEP (Direct Electrographic Printing). All these devices are able to perform grey scale printing either by voltage modulation or by time modulation of the voltages applied to the control electrodes. We have found that, when printing apertures with small diameter are used in DEP, stable voltage amplitude modulation or stable time modulation can be applied to the control electrode of the printing apertures and that both high and low density can be recorded at a high spatial resolution. Therefore, it is advantageous to use printing apertures with small diameter.

The smaller the diameter of the printing apertures, the higher the risk of clogging of said apertures by toner particles. Therefore it is preferred, for high quality DEP, to combine small printing apertures with a thin insulating layer between control and shield electrode. In a preferred embodiment said insulating material is at most 100 $\mu$m, more preferably at most 75 $\mu$m thick.

In DEP it is important that every single printing aperture is addressable in such a way that the amount of toner particles passing through said single printing aperture is a smooth function of the voltage applied between the control electrode surrounding said aperture and the shield electrode. The toner density upon the receiving paper under each printing aperture has in its ideal way a Gaussian distribution which is completely identical for every individual aperture. It is moreover important, since it is necessary to be able to print with a DEP device—when several printing apertures cooperate—patches of even density, that the amount of toner particles passing through every printing aperture follows the same smooth function of the voltage applied between the control electrode surrounding said aperture and the shield electrode. When this it not so, the electronic control system of the DEP device has to become complicated since it has to accommodate for the different functions of amount of toner particles versus applied voltage, associated with different printing apertures.

It has been found that the problems above can be mastered when the control electrode around every single printing aperture stays insulated from the shield electrode associated with the printing aperture. It was found that the insulation between control and shield electrode around each aperture has to be such that, when a potential difference of two times the normal working potential difference is applied to both electrodes, no short-circuiting of both electrodes appears. No short-circuiting means in this context that between both said electrode a current lower than the limiting current of the leakage current switch, incorporated in the voltage source (i.e. lower than 5 mA, preferably lower than 2 mA), can be tolerated.

It was however found that insulated has, in this context, not to mean that, at the working potential difference (mostly between 200 and 300 V), absolutely no current should flow through the printing apertures from the control electrode (surrounding said printing aperture) to the shield electrode. It was found that in order to operate a DEP device in a stable and reproducible way during an acceptable period of time, a current of at most 50 $\mu$A flowing through the printing apertures from the control electrode (surrounding said printing aperture) to the shield electrode, when applying a potential difference of 200 V between said control and shield electrode, could be tolerated. It was found that the period of time during which a DEP device can be operated in a stable and reproducible way is enhanced when, in the circumstances mentioned above, a current of not more than 10 $\mu$A, most preferably of not more than 3 $\mu$m, flowing through the printing apertures from the control electrode (surrounding said printing aperture) to the shield electrode, was tolerated.

When furtheron in this text a value of an electric current flowing through a printing aperture is mentioned, it is always understood that a potential difference of 200 V has been applied between control and shield electrode before measuring the current.

The electrodes (both control electrode and shield electrode) are preferably made of metal, most preferably of copper or aluminium. When a current larger than 50 $\mu$A is allowed to flow through the printing apertures from the control electrode (surrounding said printing aperture) to the shield electrode, local heating of the printhead structure around the printing aperture is taking place. This local heating can result in changing adhesive behaviour to the passing toner particles which can lead to further melting, carbonization and a further increase in current flow which again can even cause melting of the metal electrodes, the molten metal then can flow trough the printing aperture, making contact between control and shield electrode. By this filamentary contact even more current can flow through the aperture and more heating takes place, that can—in the extreme—result in burning of the insulating material between both electrode and in total unemployability of the printing aperture.

It was also found that, when a current higher than 50 $\mu$A is allowed to flow through the printing apertures from the control electrode (surrounding said printing aperture) to the shield electrode, the electrical field extending over the printing aperture is no longer homogeneous and that thus the function of amount of toner particles versus applied voltage is changed when compared to printing apertures where only a current of less than 50 $\mu$A is allowed to flow through.

The fringing fields around these "leaking" printing apertures further causes that the net throughput of toner particles is no longer Gaussian with respect to the aperture centre, which leads to unevenness in image areas of (intended) even density.

Producing printing apertures

We have found that printhead structures with small (diameter smaller than 200 μm, preferably smaller than 100 μm) printing apertures can be made with various fabrication methods known in the art, as long as the resulting printing aperture is such that, when applying a potential difference of 200 V between said control and shield electrode, a current of at most 50 μA flows through said printing aperture.

A possible way to make the printing apertures, when these are around 300 μm is rigorous mechanical drilling. For smaller (i.e. below 200 μm, preferably below 100 μm) aperture diameters, however, this way of working is impossible. In that case laser burning is a fabrication process that is well known to those skilled in the art, it is very frequently used for the nozzle fabrication process in ink jet printheads. Since by laser burning, the printhead structure is locally heated, it is necessary to take special precautions to avoid the carbonization of the plastic insulating material or even the melting of the electrode material, since other wise good-conduction filaments risks to be formed through the printing aperture and so short-circuiting the control and shield electrode is the consequence. For those skilled in the art it is obvious to use special environmental conditions, such as e.g. using nitrogen or xenon atmosphere, in order to overcome most of the problems with carbonization. Nevertheless, it is extremely difficult to avoid it completely, nor is it obvious to get rid of all problems concerned with copper degradation and melting, by e.g. special cooling.

The most preferred way to produce printing apertures fulfilling the conditions of the present invention, is plasma etching. Plasma etching is normally carried out by means of a gas or a gas mixture, which is transformed into plasma by high-frequency energy. For plasma etching of flexible printed circuit boards it is known to those skilled in the art to use a mixture of tetrafluoromethane and oxygen. The reactive particles of the plasma can be ions or free radicals which do react very efficiently with organic substrate materials such as e.g. polyimide and acrylic adhesives, which will completely dissolve. The risk that during the manufacture of the printing apertures the electrode material melts (forms filaments) and flows through the printing aperture to short-circuit control electrode and shield electrode is inexistent. Since plasma etching is always performed in a well controlled gas atmosphere, the process of local carbonization can also be excluded completely. It is moreover observed that the smoothness of the walls of the printing apertures is very good when using plasma etching. This smoothness of the walls helps to avoid clogging of the printing apertures.

Good results can also be obtained by combined laser/plasma etching techniques if a method is used of proper focusing and positioning the laser beam whereby an aperture with smaller diameter (than the one finally needed in the printing aperture) is burned through the insulating material. After this initial laser burning a plasma etching step follows to enlarge the diameter of the laser burned aperture to the final diameter of the printing aperture. This results in a better tuning of the insulating power between the shield electrode and the control electrodes.

A preferred method for making a printhead structure (106) comprising individual control electrodes (106*a*) in combination with printing apertures (107) and a shield electrode (106*b*), both electrodes separated by an insulating material is characterised by the steps of:

(i) etching the electrode material chemically over the whole diameter of the printing apertures to free the insulating material and (ii) plasma etching the insulating material.

In a further preferred embodiment the method for producing printhead structures according to the present invention comprises the steps of (i) etching the electrode material chemically over the whole diameter of the printing apertures to free the insulating material (ii) laser burning a part of said diameter of said printing apertures trough said insulating material and (iii) plasma etching the remaining insulating material until the whole diameter of said printing aperture is reached.

When the method for making a printhead structure according to the present invention comprises the step of laser burning it is preferred that a hole having a diameter of at most 60% of said whole diameter of said printing apertures is made by laser burning. In another preferred embodiment of the method, for making a printhead structure according to the present invention, comprising the step of laser burning, several holes having a diameter of at most 35% of said whole diameter of said printing apertures are made by laser burning in the surface of said insulating material determined by said whole diameter.

Description of the DEP device

A non limitative example of a device for implementing a DEP method using toner particles according to the present invention comprises (FIG. 1):

(i) a toner delivery means (101), comprising a container for developer (102) and a magnetic brush assembly (103), this magnetic brush assembly forming a toner cloud (104)

(ii) a back electrode (105)

(iii) a printhead structure (106), made from a plastic insulating film, coated on both sides with a metallic film. The printhead structure (106) comprises one continuous electrode surface, hereinafter called "shield electrode" (106*b*) facing in the shown embodiment the toner delivering means and a complex addressable electrode structure, hereinafter called "control electrode" (106*a*) around printing apertures (107), facing, in the shown embodiment, the toner receiving member in said DEP device. The location and/or form of the shield electrode (106*b*) and the control electrode (106*a*) can, in other embodiments of a device for a DEP method, be different from the location shown in FIG. 1.

(iv) conveyer means (108) to convey an image receptive member (109) for said toner between said printhead structure and said back electrode in the direction indicated by arrow A.

(v) means for fixing (110) said toner onto said image receptive member.

Although in FIG. 1 an embodiment of a device for a DEP method using two electrodes (106*a* and 106*b*) on printhead 106 is shown, it is possible to implement a DEP method using devices with different constructions of the printhead (106). It is, e.g. possible to implement a DEP method with a device having a printhead comprising only one electrode structure as well as with a device having a printhead comprising more than two electrode structures. The printing apertures in these printhead structures can have a constant diameter, or can have a broader entrance or exit diameter. The back electrode (105) of this DEP device can also be made to cooperate with the printhead structure, said back electrode being constructed from different styli or wires that are galvanically insulated and connected to a voltage source as disclosed in e.g. U.S. Pat. No. 4,568,955 and U.S. Pat. No. 4,733,256. The back electrode, cooperating with the printhead structure, can also comprise one or more flexible PCB's (Printed Circuit Board).

Between said printhead structure (106) and the magnetic brush assembly (103) as well as between the control electrode around the printing apertures (107) and the back electrode (105) behind the toner receiving member (109) as well as on the single electrode surface or between the plural electrode surfaces of said printhead structure (106) different electrical fields are applied. In the specific embodiment of a device, useful for a DEP method, shown in FIG. 1. voltage V1 is applied to the sleeve of the magnetic brush assembly 103, voltage V2 to the shield electrode 106*b*, voltages $V3_0$ up to $V3_n$ for the control electrode (106*a*). The value of V3 is selected, according to the modulation of the image forming signals, between the values $V3_0$ and $V3_n$, on a timebasis or grey-level basis. Voltage V4 is applied to the back electrode behind the toner receiving member. In other embodiments of the present invention multiple voltages $V2_0$ to $V2_n$ and/or $V4_0$ to $V4_n$ can be used.

In a DEP device according to a preferred embodiment of the present invention, said toner delivery means 101 creates a layer of multi-component developer on a magnetic brush assembly 103, and the toner cloud 104 is directly extracted from said magnetic brush assembly 103. In other systems known in the art, the toner is first applied to a conveyer belt and transported on this belt in the vicinity of the printing apertures. A device according to the present invention is also operative with a mono-component developer or toner, which is transported in the vicinity of the printing apertures (107), via a conveyer for charged toner. Such a conveyer can be a moving belt or a fixed belt. The latter comprises an electrode structure generating a corresponding electrostatic travelling wave pattern for moving the toner particles.

The magnetic brush assembly (103) preferentially used in a DEP device according to an embodiment of the present invention can be either of the type with stationary core and rotating sleeve or of the type with rotating core and rotating or stationary sleeve.

Several types of carrier particles, such as described in the EP-A 675 417, filed on Apr. 14th 1994, and titled "a method and device for direct electrostatic printing (DEP)" can be used in a preferred embodiment of the present invention.

Any toner particles, black, coloured or colourless, can be used in a DEP device comprising a printhead structure according to the present invention. It is preferred to use toner particles as disclosed in European Application 94203464.6 filed on Nov. 29, 1994, that is incorporated by reference, in combination with a printhead structure according to the present invention.

A DEP device making use of the above mentioned marking toner particles can be addressed in a way that enables it to give black and white. It can thus be operated in a "binary way", useful for black and white text and graphics and useful for classical bilevel halftoning to render continuous tone images.

A DEP device according to the present invention is especially suited for rendering an image with a plurality of grey levels. Grey level printing can be controlled by either an amplitude modulation of the voltage V3 applied on the control electrode 6*a* or by a time modulation of V3. By changing the duty cycle of the time modulation at a specific frequency, it is possible to print accurately fine differences in grey levels. It is also possible to control the grey level printing by a combination of an amplitude modulation and a time modulation of the voltage V3, applied on the control electrode.

The combination of a high spatial resolution, obtained by the small-diameter printing apertures (107), and of the multiple grey level capabilities typical for DEP, opens the way for multilevel halftoning techniques, such as e.g. described in the EP-A 634 862, filed on Jun. 29, 1994 with title "Screening method for a rendering device having restricted density resolution". This enables the DEP device, according to the present invention, to render high quality images.

EXAMPLES

The DEP device

A printhead structure (106) made from a polyimide film of 50 μm thickness, double sided coated with a 17.5 μm thick copper film. The printhead structure (106) had four rows of printing apertures. The further examples differ by the way said printing apertures are made. On the back side of the printhead structure, facing the receiving member substrate, a ring shaped control electrode (106*a*) was arranged around each aperture. Each of said control electrodes was individually addressable from a high voltage power supply. On the front side of the printhead structure, facing the toner delivery means, a common shield electrode (106*b*) was present. The printing apertures had an aperture diameter of 85 μm. The width of the copper ring electrodes was 20 μm. The rows of printing apertures were staggered to obtain an overall resolution of 300 dpi (dots per inch or dots per 25.4 mm).

The toner delivery means (101) was a stationary core/rotating sleeve type magnetic brush comprising two mixing rods and one metering roller. One rod was used to transport the developer through the unit, the other one to mix toner with developer.

The magnetic brush assembly (103) was constituted of the so called magnetic roller, which in this case contained inside the roller assembly a stationary magnetic core, showing nine magnetic poles of 500 Gauss magnetic field intensity and with an open position to enable used developer to fall off from the magnetic roller. The magnetic roller contained also a sleeve, fitting around said stationary magnetic core, and giving to the magnetic brush assembly an overall diameter of 20 mm. The sleeve was made of stainless steel roughened with a fine grain to assist in transport (<50 μm).

A scraper blade was used to force developer to leave the magnetic roller. And on the other side a doctoring blade was used to meter a small amount of developer onto the surface of said magnetic brush assembly. The sleeve was rotating at 100 rpm, the internal elements rotating at such a speed as to conform to a good internal transport within the development unit. The magnetic brush assembly (103) was connected to an AC power supply with a square wave oscillating field of 600 V at a frequency of 3.0 kHz with 0 V DC-offset.

The developer

A macroscopic "soft" ferrite carrier consisting of a MgZn-ferrite with average particle size 50 μm, a magnetisation at saturation of 29 emu/g was provided with a 1 μm thick acrylic coating. The material showed virtually no remanence.

The toner used for the experiment had the following composition: 97 parts of a co-polyester resin of fumaric acid and propoxylated bisphenol A, having an acid value of 18 and volume resistivity of $5.1\times10^{16}$ ohm.cm was melt-blended for 30 minutes at 110° C. in a laboratory kneader with 3 parts of Cu-phthalocyanine pigment (Colour Index PB 15:3). A resistivity decreasing substance—having the following structural formula: $(CH_3)_3N^+C_{16}H_{33}Br^-$ was added in a quantity of 0.5% with respect to the binder. It was found that—by mixing with 5% of said ammonium salt—the volume resistivity of the applied binder resin was lowered to $5\times10^{14}$ Ω.cm. This proves a high resistivity decreasing capacity (reduction factor: 100).

After cooling, the solidified mass was pulverized and milled using an ALPINE Fliessbettgegenstrahlmühle type 100AFG (tradename) and further classified using an ALPINE multiplex zig-zag classifier type 100MZR (tradename). The resulting particle size distribution of the separated toner, measured by Coulter Counter model Multisizer (tradename), was found to be 6.3 μm average by number and 8.2 μm average by volume. In order to improve the flowability of the toner mass, the toner particles were mixed with 0.5% of hydrophobic colloidal silica particles (BET-value 130 $m^2/g$).

An electrostatographic developer was prepared by mixing said mixture of toner particles and colloidal silica in a 4% ratio (w/w) with carrier particles. The tribo-electric charging of the toner-carrier mixture was performed by mixing said mixture in a standard tumbling set-up for 10 min. The developer mixture was run in the development unit (magnetic brush assembly) for 5 minutes, after which the toner was sampled and the tribo-electric properties were measured, according to a method as described in application EP-A 675 417, giving q=−7.1 fC, q as defined in said application.

The distance 1 between the front side of the printhead structure (106) and the sleeve of the magnetic brush assembly (103), was set at 450 μm. The distance between the back electrode (105) and the back side of the printhead structure (106) (i.e. control electrodes 106*a*) was set to 150 μm and the paper travelled at 1 cm/sec. The shield electrode (106*b*) was grounded: V2=0 V. To the individual control electrodes an (imagewise) voltage V3 between 0 V and −200 V was applied. The back electrode (105) was connected to a high voltage power supply of +400 V. To the sleeve of the magnetic brush an AC voltage of 600 V at 3.0 kHz was applied, without DC offset.

Production of the printing apertures

For the fabrication process of the printhead structure, accurate mechanical drilling of printing apertures with a diameter of 85 μm was impossible. For that reason the printing apertures were "created" by using fototooling and etching procedures to obtain a plastic polyimide substrate with copper coating on the shield electrode side except at the location where the printing apertures have to be made. In different experiments several different laser burning techniques were used to remove the polyimide at said location were an aperture with a diameter of 85 μm has to be created.

Example 1

In a first set of experiments a YAG-laser was used for laser-burning the printing apertures under nitrogen atmosphere, without special precautions to cool the printhead structure during laser burning. With 40 pulses a second (pulse period=4 ms, energy per pulse=0.4 J) at a focus of 250 μm, it was never possible to obtain a printhead structure, for use in the DEP device described above, which could withstand a potential difference applied between said shield electrode and said control electrodes of 200 V.

Example 2

In a second set of experiments an excimer-laser was used for laser-burning the printing apertures, again without special precautions to cool the printhead structure during laser burning. Here the same results were observed as in example 1, namely that after applying a potential difference of 200 V between said shield electrode and said control electrodes short cutting was obtained immediately.

Example 3

In a third set of experiments a CO2-laser was used for laser-burning the printing apertures at a power density of 5 to 9 J/cm2, again without special precautions to cool the printhead structure during laser burning. Here it was observed that after applying a potential difference of 200 V between said shield electrode and said control electrodes for a few minutes, the electrodes were short-circuited.

A moderate copper-after-etching to any of these three sets of experiments (examples 1 to 3) could not improve the quality of the printhead structures to what is needed for a long term stability in DEP printing.

Example 4

In a fourth set of experiments the etched pattern was used in a process of plasma etching for removing the polyimide at these locations where an aperture has to be created. During the etching the rest of the structure is covered with a thin protective mask, that is removed after the etching is completed. The holes were drilled in 10 minutes in an atmosphere of 80% freon and 20% oxygen. The pressure of the freon/oxygen atmosphere was 133 Pa (1 Torr). The etching proceeded at an RF-frequency of 13.5 MHz. This gave printhead 1 (PH1). In this set of experiments, where PH1 was used in the DEP device described above, the voltage difference of 200 V between said shield electrode and said control electrodes could be applied for hours and the current flow from said shield electrode to said control electrodes was lower than 1.5 μA for a measuring set of 400 electrode pairs. This is an indication for a good long term stability for a DEP device made by the incorporation of a printhead structure fabricated in this way, i.e by using the technique of plasma etching.

Example 5

Good results are also obtained by combined laser/plasma etching techniques if a method is used of proper focusing and positioning the laser beam whereby an aperture with smaller diameter (than the one finally needed in the printing aperture) is burned through the insulating material. After this initial laser burning a plasma etching step follows to enlarge the diameter of the laser burned aperture to the final diameter of the printing aperture. This results in a better tuning of the insulating power between the shield electrode and the control electrodes. In this way DEP-printhead structures were fabricated by using $CO_2$-laser burning in combination with plasma etching. In table 1 the results are given for several examples in which the inner focusing of the first laser beam was varied and as a result the plasma etching time was changed so as to obtain the aperture diameter of 85 μm.

Printheads 2 to 5 (PH2 to PH5), were produced by the combination of laser burning and plasma etching. The laser burning proceeded by an IMPACT (trademark) Laser System (available through LUMONICS Ltd, European Sales Division, Brussels). The apparatus was operated in the contact mask scanning ablation mode. The contact mask was made in the conventional (chemical etching) way from a 25 μm thick polyimide coated with a 17.5 μm thick Cu-layer. By the contact mask scanning method a positioning accuracy of a few μm was attained. After laser burning, with a $CO_2$ laser, the diameter of the resulting holes was widened to the desired value (in this case 85 μm) by plasma etching as described for the production of printhead 1 (PH1), only the etching times were adapted to the amount of material that had to be removed.

In the production of PH2 to PH5, 4 contact mask were used having a hole diameter of 30, 50, 70, 80 μm respectively, this means that for PH2 55 μm were plasma etched, for PH3 35 μm, for PH4 15 μm and for PH5 only 5 μm were plasma etched. The plasma etching time was 390, 250, 105 and 35 seconds respectively.

After applying, in a DEP device as described above, a potential difference of 200 V between said shield electrode and control electrodes a resultant current was measured as tabulated in table 1. Also given in table 1 is the overall quality that was given to samples printed by these printhead structures, said quality being determined in black and grey full density areas. Since the human eye is very sensitive to small density fluctuations in even grey areas, the visual appreciation of the evenness of the printing of grey surfaces is a very good criterion to judge the quality of the printhead structures.

TABLE 1

| Printhead | Current at potential difference of 200 V | Printing Quality |
|---|---|---|
| PH5 | 2 mA over 10% of the printing apertures | bad + defects (non working printing apertures)* |
| PH4 | 120 μA | moderate |
| PH3 | 9 μA | good |
| PH2 | 1.2 μA | very good |
| PH1 | 0.7 μA | very good |

*Image signals are varied between 0 and - 200 V, with a current limit of 2 mA per aperture.
**can only be used when a complicated electronic control system is installed in the DEP device using such a printhead.

We claim:

1. An apparatus for direct electrostatic printing comprising:

a back electrode;

means for delivering dry toner particles forming a flow of dry toner particles;

a printhead structure interposed in said flow of dry toner particles for image-wise modulating said flow of dry toner particles, said printhead structure comprising:

a plastic insulating layer;

a plurality of control electrodes disposed on a first side of said plastic insulating layer;

a shield electrode disposed on a second side of said plastic insulating layer; and a plurality of printing apertures each having a respective diameter D formed through said plastic insulating layer between each of said control electrodes and said shield electrode, each of said printing apertures comprising a plasma-etched periphery, formed by plasma etching said insulating layer to form said printing apertures to said respective diameter D, for eliminating carbonization of said plastic insulating layer and melting of said control electrode and said shield electrodes at said printing apertures, said periphery being formed such that a current of no more than 50 μA flows between each of said control electrodes and said shield electrode when a potential difference of 200V is applied therebetween.

2. The apparatus according to claim 1, wherein said current is no more than 10 μA.

3. The apparatus according to claim 1, wherein said current is no more than 3 μA.

4. The apparatus according to claim 1, wherein said plastic insulating layer is less than 100 μm thick.

5. The apparatus according to claim 1, wherein said printing apertures have a diameter less than 200 μm.

6. The apparatus according to claim 1, wherein said printing apertures have a diameter less than 100 μm.

7. The apparatus according to claim 1, further comprising a back electrode for cooperating with said printhead structure.

8. The apparatus according to claim 1, wherein at least one of said printing apertures is formed at least in part by laser-burning a portion of said plastic insulating layer to an initial diameter less than said respective diameter D.

9. A printhead structure for direct electrostatic printing comprising:

a plastic insulating layer;

a plurality of control electrodes disposed on a first side of said plastic insulating layer;

a shield electrode disposed on a second side of said plastic insulating layer; and a plurality of printing apertures each having a respective diameter D formed through said plastic insulating layer between each of said control electrodes and said shield electrode, each of said printing apertures comprising a plasma-etched periphery, formed by plasma etching said insulating layer to form said printing apertures to said respective diameter D, for eliminating carbonization of said plastic insulating layer and melting of said control electrodes and said shield electrode at said printing apertures, said periphery being formed such that a current of no more than 50 μA flows between each of said control electrodes and said shield electrode when a potential difference of 200V is applied therebetween.

10. The printhead structure according to claim 9, wherein said current is no more than 10 μA.

11. The printhead structure according to claim 9, wherein said current is no more than 3 μA.

12. The printhead structure according to claim 9, wherein said plastic insulating layer is less than 100 μm thick.

13. The printhead structure according to claim 9, wherein said printing apertures have a diameter less than 200 μm.

14. The printhead structure according to claim 9, wherein said printing apertures have a diameter less than 100 μm.

15. The apparatus according to claim 9, wherein at least one of said printing apertures is formed at least in part by laser-burning a portion of said plastic insulating layer to an initial diameter less than said respective diameter D.

16. A method for forming a printhead structure for a direct electrostatic printing device using dry toner particles, said printhead structure having a plurality of control electrodes, a shield electrode and plurality of printing apertures, each having a respective diameter D, formed through a plastic insulating layer, said method comprising the steps of:

disposing electrode material on first and second sides of said plastic insulating layer to form said control and shield electrodes;

chemically etching said electrode material to expose said plastic insulating layer at each of said printing apertures; and plasma etching said exposed plastic insulating layer at each of said printing apertures to form a corresponding periphery at each of said printing apertures to said respective diameter D, and to eliminate carbonization of said plastic insulating layer and melting of said control electrodes and said shield electrode at each of said printing apertures such that a current of no more than 50 $\mu$A flows between each of said control electrodes and said shield electrode when a potential difference of 200V is applied therebetween.

17. The method according to claim 16, further comprising the step of laser burning a portion of said exposed plastic insulating layer at each of said printing apertures prior to said plasma etching step.

18. The method according to claim 17, wherein said laser-burned portion of said exposed plastic insulating layer is no larger than 60% of a area of said exposed plastic insulating layer at each of said printing apertures.

19. The method according to claim 17, wherein said laser-burned portion of said exposed plastic insulating layer is no larger than 35% of a area of said exposed plastic insulating layer at each of said printing apertures.

* * * * *